United States Patent [19]

Gädke et al.

[11] Patent Number: 4,834,150

[45] Date of Patent: May 30, 1989

[54] APPARATUS FOR THE REMOTE CONTROL OF A TRANSFER OPERATION

[75] Inventors: Herbert Gädke, Bohnert; Peter Steinhauer, Tangstedt; Franz-Xaver Jahn, Munich; Bernd Schade, Erlangen; Werner Graf, Munich, all of Fed. Rep. of Germany

[73] Assignee: Siemens Aktiengesellschaft, Berlin & Munich, Fed. Rep. of Germany

[21] Appl. No.: 74,132

[22] Filed: Jul. 16, 1987

Related U.S. Application Data

[63] Continuation-in-part of Ser. No. 906,316, Sep. 11, 1986, abandoned.

[51] Int. Cl.[4] ..... B67D 5/26

[52] U.S. Cl. ..... 141/98; 141/94; 141/192; 222/23; 222/52

[58] Field of Search ..... 222/23, 52, 26, 630, 222/639; 191/1 R; 141/1, 98, 94, 83, 192, DIG. 2, 392; 137/551, 552.7

[56] References Cited

U.S. PATENT DOCUMENTS

| | | | |
|---|---|---|---|
| 3,897,887 | 8/1975 | Goldberg | 222/26 |
| 4,087,858 | 5/1978 | Pichler et al. | 222/23 X |
| 4,109,686 | 8/1978 | Phillips | 141/1 |
| 4,263,945 | 4/1981 | Van Ness | 141/98 |
| 4,469,149 | 9/1984 | Walkey et al. | 141/94 |
| 4,630,754 | 12/1986 | Komukai | 222/28 |

FOREIGN PATENT DOCUMENTS

| | | | |
|---|---|---|---|
| 1123938 | 5/1982 | Canada . | |
| 153035 | 8/1985 | European Pat. Off. | 141/98 |
| 2339327 | 2/1975 | Fed. Rep. of Germany . | |
| 2450074 | 5/1976 | Fed. Rep. of Germany . | |
| 2509309 | 3/1980 | Fed. Rep. of Germany . | |
| 1465060 | 1/1967 | France . | |

*Primary Examiner*—Ernest G. Cusick

*Attorney, Agent, or Firm*—Kenyon & Kenyon

[57] ABSTRACT

The invention relates to apparatus for the remote control of transfer operations, in which a material to be transferred is taken from a supply tank into tanks to be filled, where a control signal with start and stop function is given by a hand station (1) to a control device at the delivery system for maintaining the transfer operation, while holding the filling valve open and in operation. The hand station (1) is equipped with a separate start and stop signal transmitter (14; 15) and a status indicator is also provided for assisting the operator.

7 Claims, 5 Drawing Sheets

3
4
19
17
18
16
16
16
20
21
22
23
24
24
24
S1
S2
S3
S4
T2
T1
A
B
CD
Q̄
VDD
VSS
2a
2b
2c

APPARATUS FOR THE REMOTE CONTROL OF A TRANSFER OPERATION

CROSS REFERENCE

This is a continuation-in-part to application Ser. No. 906,316 filed Sept. 11, 1986, now abandoned.

BACKGROUND OF THE INVENTION

1. Field of Invention

The invention relates to apparatus for the remote control of transfer operations in which a material is transferred from a supply tank into a tank to be filled and more particularly for a device for the failsafe manual remote control of a valve and pump used in the filling operation.

2. Description of the Prior Art

In a known device for the remote control of tanking operations at airports, a manual device such as a hand rubber ball, button or lever switch, is connected by a hose or cable to the control device of the tanker and is maintained in an activated state by the operator as long as the filling operation is to continue. If the manual device is released, the control device closes the filling valve. Such a device is very inconvenient for the operator, as it can cause cramps in the operator's hand. In practice, the operator is not precluded from blocking the manual device. Thus, a hand rubber ball can be wedged and pressed down under a wheel of the tanker thereby defeating its safety function. However, in certain instances, such as refueling of aircraft remote manual control is absolutely essential because it is not assured in practice that the amount of fuel to be taken on as requested the flight personnel is accurate or is consistent with the capacity of the tank. Incorrect setting of the desired amounts at the control device is another source of error. Furthermore, the tanker hose can also become defective or other problems can occur.

Similar problems occur generally in the transfer of dangerous liquids or other materials such powders or granular materials. The danger may be due to flammability, poisonous nature or the like of these materials. It may also involve expensive material which must not be spilled or generally operations executed by robots which are to be controlled effectively by hand.

SUMMARY OF THE INVENTION

It is an object of the invention to develop apparatus for the remote control of transfer operations which is substantially safer than the devices commercially available and which is more comfortable for the operator.

According to this invention, a hand station for controlling fluid flow into a tank is equipped with a separate start and stop signal transmitter which interacts with the control device at the carrier of the supply tank in the following manner:

After the control device is turned on, a state indicator is switched to "ready". After a start signal is actuated, the control device deactivates the state indicator, and the filling valve is opened for the pumping operation. After a first time interval, the state indicator is activated again. Until the end of a second time interval, the filling valve is kept open, the pump remains turned on and the filling operation can be reactivated by the start signal. Without actuation of the start signal, however, the filling valve is closed and the pump is shut down, or brought to a reduced output, for instance by reducing its speed. The filling valve can be closed and the pump turned off or its output reduced at any time by activating a stop signal.

Thereby, safety functions as well as control measures of the transfer operation are possible from the hand station without adverse mutual interaction.

The safety function is met in principle by a so-called dead man's circuit. A similar dead man's circuit is known as a safety travel circuit for the wireless remote control of locomotives in such a manner (German Pat. No. 24 50 074) that an emergency stop is initiated if in a first time interval, an acoustic-optical signal transmitter has been put in operation and during a subsequent second time interval, a control command for changing the state of motion of a locomotive is not given. Although such a safety travel circuit as well as the simpler dead man's circuit at the control station of locomotives have been known for a long time, their use for securing tanking operations has not been considered to date. In practice and in the literature, in particular, references are lacking as to how known dead man's circuits could be adapted to tanking operations.

In practice, it is advisable to arrange the control advice at the delivery system, for instance, at a tank vehicle in such a manner that upon receipt of the stop signal, not only is the filling valve closed and the pump is shut down or its output reduced but at the same time the state indicator is activated.

According to a further embodiment, the hand station is equipped with an infrared transmitter with a start and stop signal transmitter and the control device has an infrared receiver which can be tuned to the infrared transmitter. By using infrared light as the transmission medium, interference by electromagnetic field and/or by acoustical interference waves is eliminated.

The hand station can be equipped with an infrared transmitter with a start and a stop signal transmitter and with a coding device, where the control device comprises an infrared receiver which can be turned to the infrared transmitter by a single-command decoder as a security measure. Such coding devices are absent in the known safety circuits.

A suitable circuit for the control device consists of the infrared receiver with an amplifier and is followed by a decoder, the output of which is connected via single-command decoder, first, to a decimal decoder as part of a counting device which obtains its timing by a clock generator, and second, directly to a time-setting device of the counting device. The time-setting device sets the duration of the first and second time intervals. The output of the time setting device for the first time interval is connected to the state indicator and the output of the time setting device for the second time interval with the addressing device for the filling valve. The filling valve may be controlled directly or through an intermediate control valve.

BRIEF DESCRIPTION OF THE FIGURES

The invention will now be explained in greater detail by reference to embodiment examples illustrated schematically in the drawings.

DESCRIPTION OF THE PREFERRED EMBODIMENT

Figure 1:
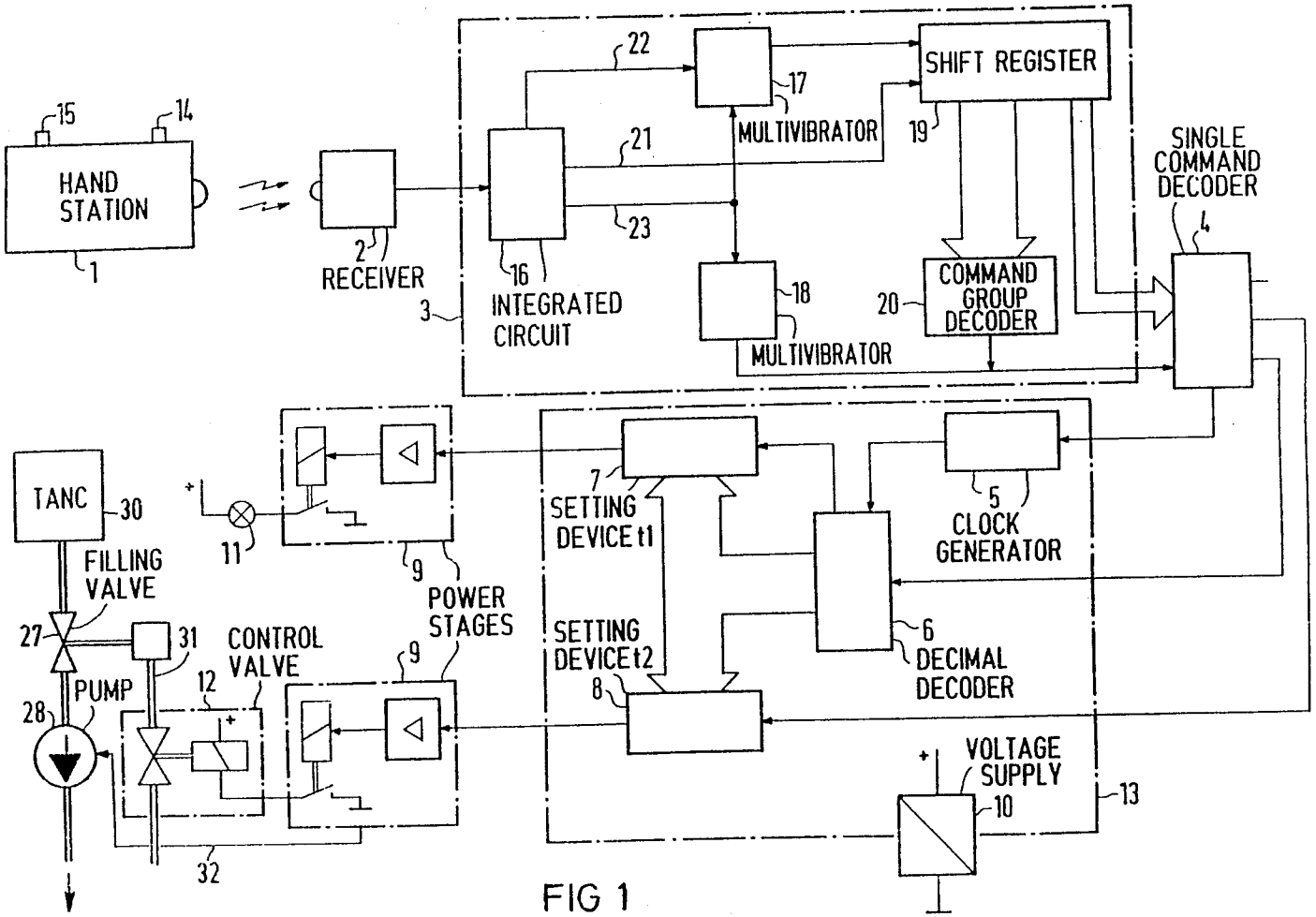
FIG. 1 shows a block diagram for a preferred embodiment for an apparatus for the remote control.

The apparatus for the remote control of the transfer operations according to FIG. 1 comprises a hand station and a control device which selectively activates state indicator (i.e., a lamp) 11 and a control valve 12. The hand station 1 may be realized as an infrared transmitter with a coding device, in which case the control device may comprise a receiver 2, including an infrared receiver with a pre-amplifier. The control device further consists substantially of a decoder, 3, a single-command decoder 4, a counting device 13 as well as of power stages 9, 9' for the state indicator 11, and the control valve 12. The individual subassemblies of the control device are connected to a voltage supply 10. The hand station 1 has a start signal transmitter 14 and a stop signal transmitter 15.

A tank or storage container holds the material to be dispensed. The contents of tank 30 are pumped out by pump 28 through a filling valve 27. The filling valve is operated by a control valve 12 by using either hydraulic or pneumatic control signals, through pipe 31. In addition, if desired, pump 28 may be selectively operated by means of a control signal on line 32 from stage 9.

The decoder 3 consists of an integrated circuit 16 for the infrared signal evaluation, for instance, a SAB 3209, monostable multivibrators 17 and 18, a shift register 19 and a command group decoder 20. The counting device 13 consists substantially of a clock generator 5 such as an oscillator; a decimal decoder 6, a time setting device 7 for the first time interval t1 and a time setting device 8 for the second time interval t2.

The apparatus operates as can be seen from the following function table for each action at the hand station 1 or at the control device at the delivery system:

| ACTION | LAMP (State indicator 11) | FILLING VALVE 27 |
|---|---|---|
| 1 | Off | Closed |
| 2 | On | Closed |
| 3 | Off | Open |
| 4 | Off | Open |
| 5 | Off | Open |
| 6 | Off/ after t1: On | Open/ after t2 Closed |
| 7 | On | Closed |
| 8 | On | Closed |

If the control device is switched off (action 1), the state indicator 11 is turned off and the filling valve 27 is closed. If the control device at the delivery system is switched on (action 2), the state signal transmitter is switched on and the filling valve remains closed. If the start signal transmitter 14 of the hand station 1 is then actuated (action 3), the state signal transmitter 11 is switched off and the filling valve 27 is opened. If the start signal transmitter 1 is actuated again within the first time interval t1 (action 4), the state indicator 11 remains switched off and the filling valve remains open. If the start signal transmitter is operated within the second time interval after the state signal transmitter had been switched on (action 5), the state signal transmitter is switched off again and the filling valve remains open.

If the start signal transmitter is operated at the beginning of the transfer operation and is not operated again during period t1 (action 6), the state indicator (which is initially switched off) is switched on at the end of the first time interval t1. The filling valve is open over the first time interval t1 and it is closed at the end of the second time interval t2. If the start signal transmitter 14 is not operated at the beginning of a filling operation, the state indicator remains switched on and the filling valve remains closed (action 7). Any time the stop signal transmitter 15 of the hand station 1 is actuated, the state indicator 11 is switched on and the filling valve is closed (action 8).

By example, for refuelling an aircraft, the supply requested fuel quantity filled is first set at an overfill protection device (not shown). The control device at the delivery system is then switched on and pumping of fuel begins by activating the start signal transmitter 14 at the hand station 1. The different operating states have been explained with the aid of the table. The tanking operation is terminated if the hand station delivers a stop signal, by not operating the start signal transmitter or if the set quantity was delivered. In addition, the device can be adapted in a manner known per se to the situation in which a given pressure change in the pumping line, customarily in the event of a pressure increase, the control device of the filling valve closes automatically with a so-called fast stop.

If the start signal transmitter 14 is actuated at the hand station 1, the infrared transmitter sends an address consisting of a start signal, encoded information and closing command. A similar but different address is sent if the stop signal transmitter 15 is actuated. The infrared receiver 2 converts the address received as light signals into electrical signals and amplifies it in the pre-amplifier. In the first decoder 3, the integrated circuit for the signal evaluation 16, SAB 3209 contains substantially a Schmitt trigger oscillator with an externally connected tuned LC circuit (not shown) for generating the internal clock frequency. In this module the signals already processed by the pre-amplifier are amplified again and are fed at the original frequency to an the internal series interface. More particularly the information signals are fed to the shift register 19 via the data line 21. A start signal likewise is fed to the shift register 19 via the line 22 and a monostable multivibrator 17 from the comparator output of the Integrated circuit for evaluating the infrared signal, 16. A line 23 also feeds a trigger signal to the monostable multivibrators 17 and 18. In the command group decoder 20, a preset coded signal is compared with the one received from the shift register. In the case of signal agreement in the group, the single-command decoder 4 can effect the single signal comparison. In the case of agreement of both the group and individual signals, counter device 13 is enabled through single-command decoder 4.

Figures 2A, 2B:
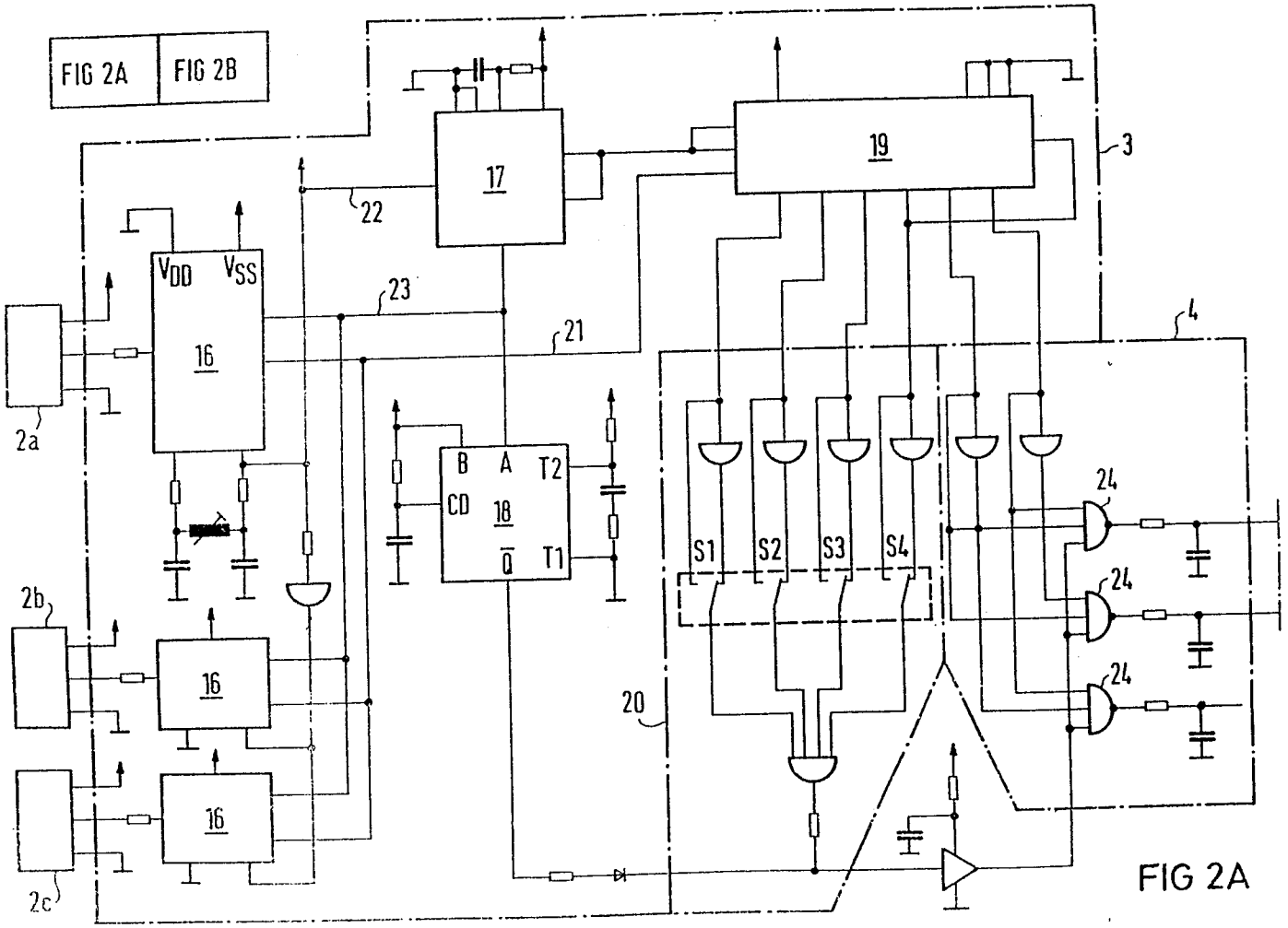
FIGS. 2A and 2B show details for the various elements of the diagram of FIG. 1.
Figure 2B:
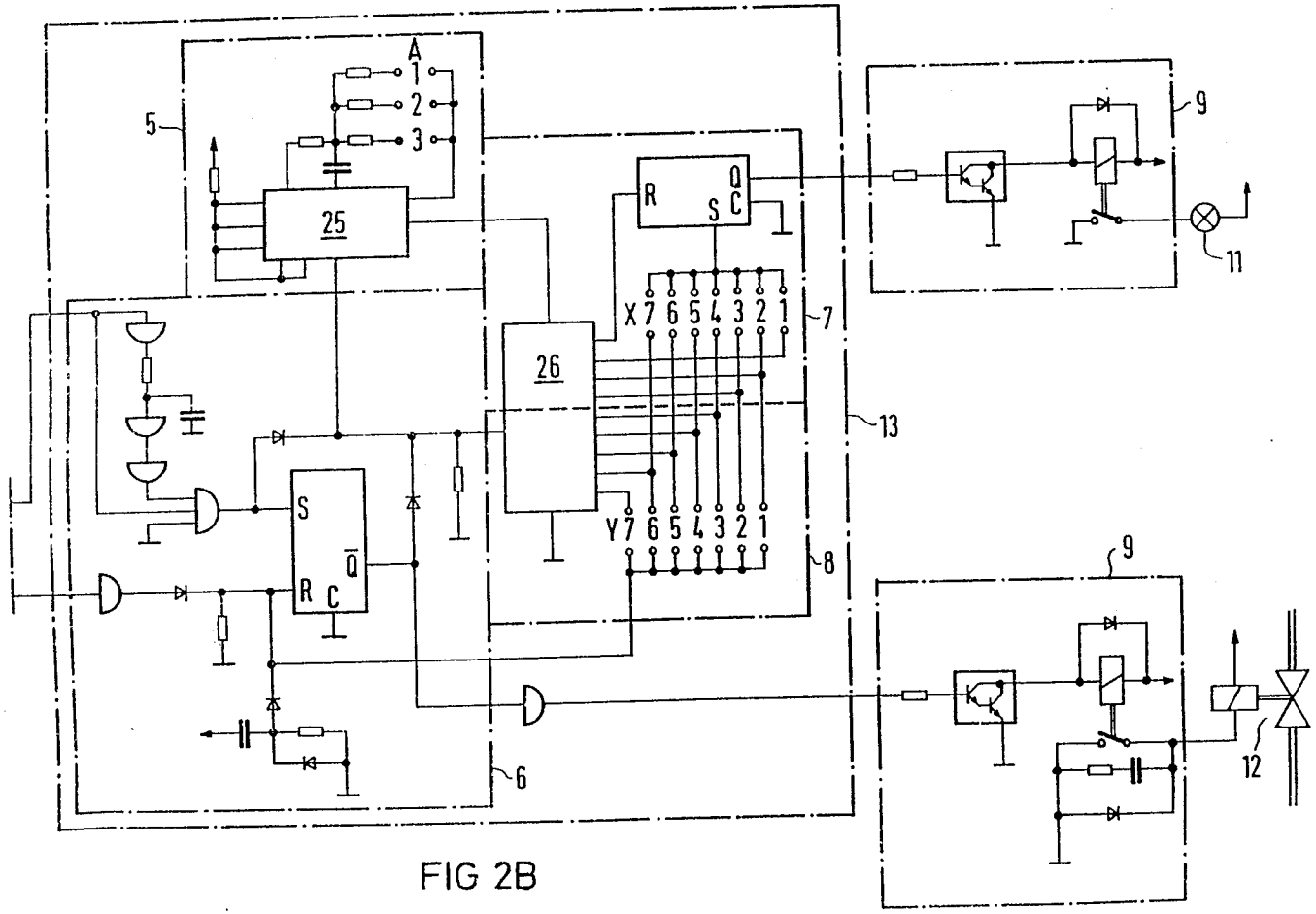
Figure 3:
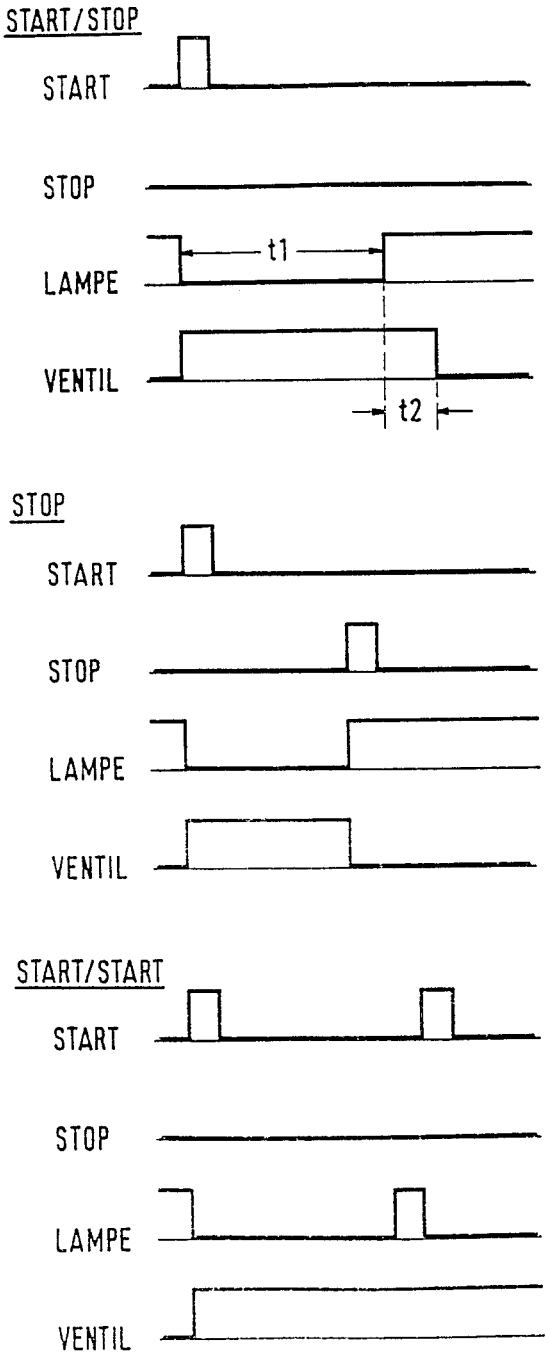
FIG. 3 shows different state diagrams for actuating the start and the stop signal transmitters together with the associated operating state of the state indicator and of the filling valve.
Figure 4:
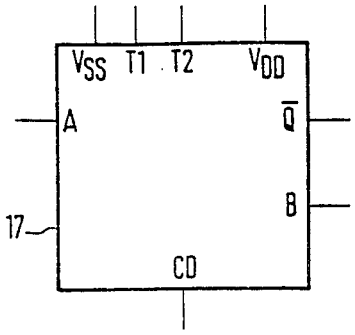
FIGS. 4, 5, 6 and 7 show the terminal assignment of the integrated circuits 17, 19, 25 and 26 used in FIGS. 2A and 2B.
Figure 5:
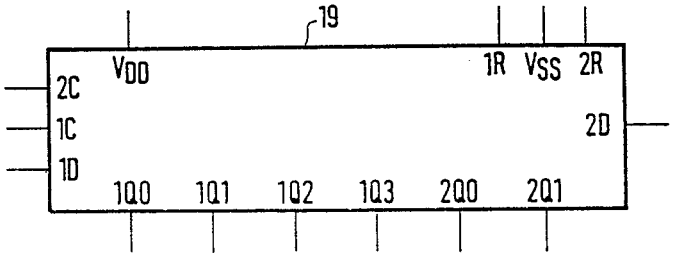
Figure 6:
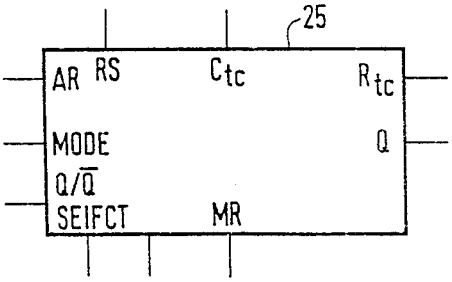
Figure 7:
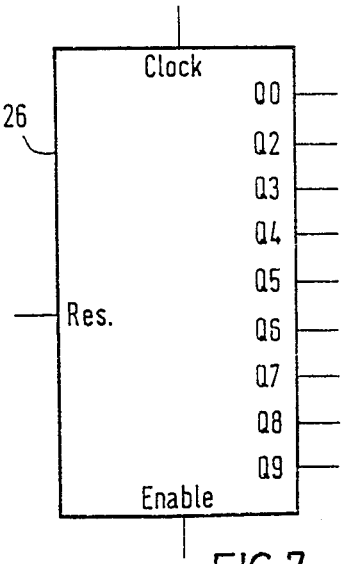

In FIGS. 2A and 2B, details of an embodiment example are shown. Three infrared receivers with pre-amplifiers *2a*, *2b* and *2c* can be connected to the decoder 3. Therefore, the receivers can be arranged at the delivery system, for instance, a tank vehicle, at three different points in order to make sure that the control device can receive commands by the hand transmitter from different positions. At the coding switches S1 to S4 of the command group decoder 20, programming can be carried out for two channels of the receiver (signal from the start signal transmitter and signal from the stop signal transmitter) upon a command of 15 command groups of two commands each and encoded thereby. The receiver decodes from the serial data sequence of the signal furnished by the preamplifier, the corresponding command and controls the output of the associated channel. Thereupon, the output of the command group decoder 20 is kept open and connected through via a driver gate 24 approximately for the duration of the actuation of the start signal transmitter at the hand transmitter 1.

In the clock generator 5, a base time of 5, 10 or 15 seconds can be set by inserting programmable jumpers A1, A2, A3. The decimal decoder 6 controls the warning and shut-off time for the state indicator 11 and for the control valve 12. in the time setting device 7, jumpers X1 to X7 can be inserted, whereby a multiple of the base time can be set as the first time interval t1. At the time-setting device 8, jumpers Y1 to Y7 can be inserted, for instance, as programming plugs, whereby a multiple of the base time can be set as a second time interval t2.

In the embodiment example, a voltage supply for +12 V to reference potential is used as the on-board network for each of the modules. The voltage supply 10 is stabilized in a manner known per se.

In the embodiment example the following standardized integrated circuits are used:

For the monostable multivibrator 17 and the monostable multivibrator 18, an MC 14538 BCP; for the shift register 19, and 14015 BCP; for the clock generator 5, an IC 25, namely, a 14541; for the decimal decoder 6, a 14027; for the time setter 7 and 8 jointly an MIC 26, namely a 14017; and ahead of the output of the time setting for the first time interval, 7, a 14027. In the power stages 9, a Darlington transistor each can be used.

Otherwise, gates, resistors and capacitors and further components are used in the manner shown.

What is claimed is:

1. An apparatus for the remote control of transfer operations in which a material is transferred from a supply system into a tank comprising:

a hand station having a start signal transmitter and a stop signal transmitter for generating start and stop signals, respectively;

a state indicator;

a filling valve for providing material from said system to said tank; and a control device for controlling said state indicator and filling valve, said control device including receiving means for receiving said start and stop signals;

said control device activating said state indicator when said control device is initially activated;

said control device opening said filling valve and deactivating said state indicator when a start signal is received;

said control device activating said state indicator after a first preset time period;

said control device at the end of a second preset time period ending after said first time period closing said valve if another start signal is not received during said second time period but maintaining said valve open if another start signal is received during said second time period;

said control device closing said valve, whenever a stop signal is received.

2. Apparatus according to claim 1 further comprising a pump for pumping material through said filling valve, said control device being provided to operate said pump simultaneously with said valve.

3. Apparatus of claim 2 wherein said pump is selectively started by said control device when said filling valve is opened, and said pump is stopped or the pump output is reduced when the filling valve is closed.

4. Apparatus according to claim 3, wherein the hand station is provided with an infrared transmitter with a start and stop signal transmitter (14; 15) with a coding device, and the control device comprises an infrared receiver which can be tuned to the infrared transmitter by a single-command decoder (4) for security.

5. Apparatus according to claim 4, wherein the infrared receiver (2) of the control device is followed by a decoder (3), the output of which is connected through said single-command decoder (4) to counting device (13) with a decimal decoder (6) which obtains its operating frequency from a clock generator (5); said counting device including a first time-setting device (7) for determining the first time interval and a second time setting device (8) for determining the second time interval, an output of the first time-setting device being connected to the state indicator (11), and an output of the time-setting device being connected to a power stage (9) for operating the filling valve.

6. Apparatus according to claim 1, wherein the control device switches the state indicator (11) on when the stop signal is received.

7. Apparatus according to claim 1, wherein the hand station is provided with an infrared transmitter with a start and stop signal transmitter (14;15) and the control device comprises an infrared receiver which can be tuned to the infrared transmitter.

* * * * *